United States Patent [19]

Haikkala et al.

[11] 4,207,139

[45] Jun. 10, 1980

[54] METHOD FOR PRODUCING GROUNDWOOD PULP

[75] Inventors: Pekka O. Haikkala, Tampere, Finland; Jonas A. I. Lindahl, Domsjö, Sweden

[73] Assignee: Mo och Domsjo Aktiebolag, Ornskoldsvik, Sweden

[21] Appl. No.: 954,714

[22] Filed: Oct. 25, 1978

[30] Foreign Application Priority Data

Feb. 16, 1978 [SE] Sweden ..... 7801814

[51] Int. Cl.[2] ..... D21B 1/16

[52] U.S. Cl. ..... 162/23; 162/28; 162/45; 162/47; 162/55; 162/71; 162/78

[58] Field of Search ..... 162/23, 24, 26, 28, 162/46, 55, 71, 47, 78, 45; 241/28

[56] References Cited

U.S. PATENT DOCUMENTS

| | | | |
|---|---|---|---|
| 3,808,090 | 4/1974 | Logan et al. | 162/28 |
| 4,029,543 | 6/1977 | Lindahl | 162/71 |
| 4,082,233 | 4/1978 | Reinhall | 162/28 |

FOREIGN PATENT DOCUMENTS

| | | | |
|---|---|---|---|
| 2335014 | 1/1975 | Fed. Rep. of Germany | 162/28 |
| 1266898 | 3/1972 | United Kingdom | 162/28 |

*Primary Examiner*—William F. Smith

[57] ABSTRACT

A process is provided for preparing groundwood pulp from debarked pulpwood logs which comprises grinding the logs under a superatmospheric pressure of a gas selected from the group consisting of steam, air and steam and air, while continuously supplying thereto process white water and water separated in thickening groundwood pulp suspension at a temperature within the range from about 75° to about 100° C., and forming a pulp suspension in the resulting aqueous liquor; centrifugally separating steam from the pulp suspension, and using the separated steam to heat the water supplied to the grinding; thickening the pulp suspension to a pulp concentration within the range from about 5 to about 40%, and supplying water separated therefrom to the grinding; diluting the thickened pulp, and screening the diluted pulp suspension; after thickening the screened rejects suspension to a pulp concentration of at least 10% and defibrating the screened rejects suspension in a refiner, recycling the defibrated screened rejects to the from-steam-separated pulp suspension; and mixing the thickened and refined rejects suspension, having a pulp concentration of at least 8%, with the pulp suspension, thereby increasing the pulp concentration of the from-steam-separated pulp suspension, and thus facilitating its thickening.

8 Claims, 1 Drawing Figure

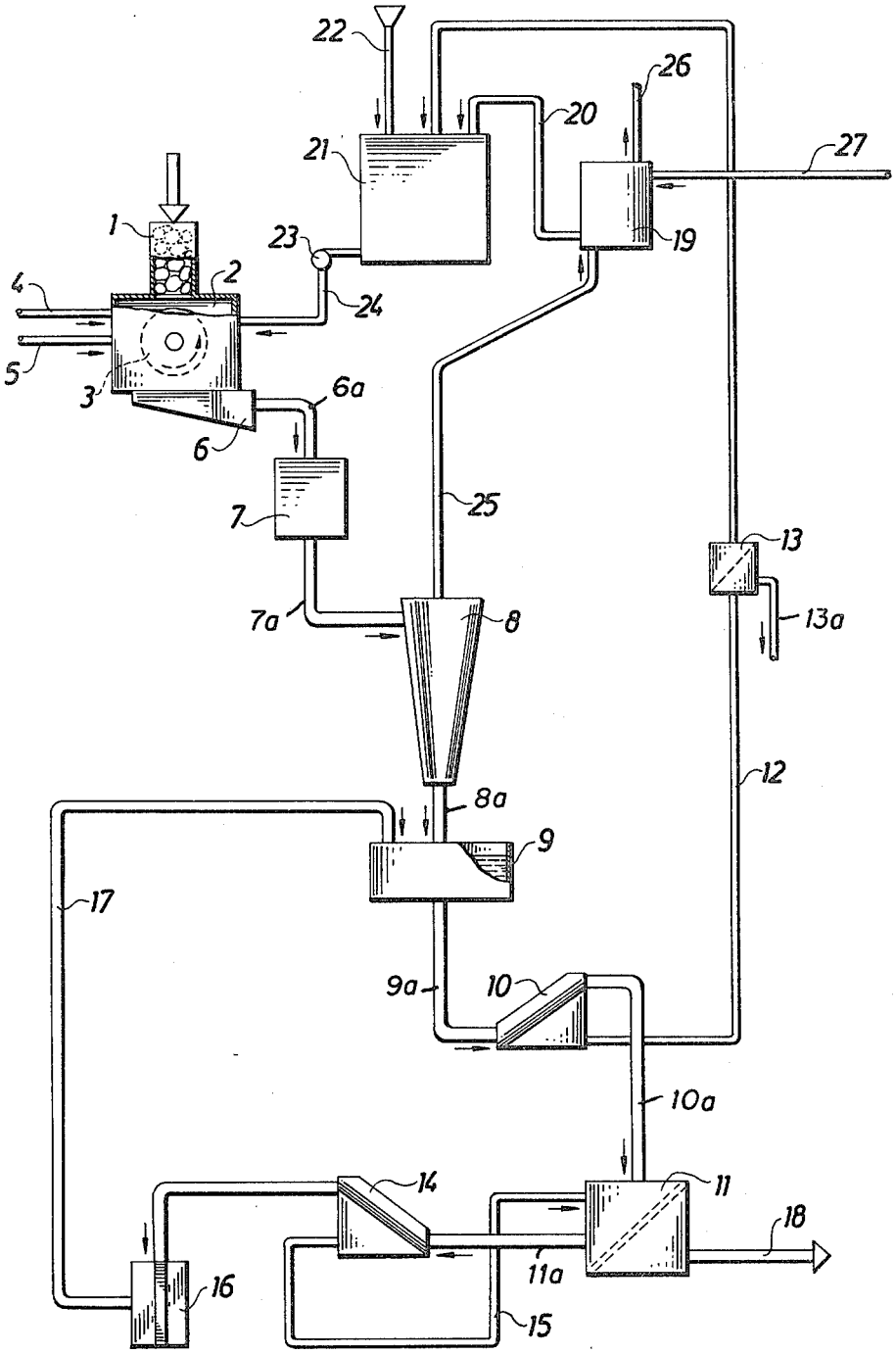
22
26
20
27
21
1
23
19
2
4
24
5
3
6a
6
7
25
13
7a
8
13a
12
8a
9
17
9a
10
10a
14
11
18
11a
16
15

METHOD FOR PRODUCING GROUNDWOOD PULP

It has been found advantageous to carry out the grinding of lignocellulosic material in the production of groundwood pulp at elevated temperatures, since this reduces the energy requirement and facilitates defibration, as well as improves the pulp and its suitability for use in the manufacture of paper. It is especially advantageous to carry out the grinding under superatmospheric pressure in the presence of steam or air at an elevated temperature, since this further reduces energy consumption, and increases the tear resistance of the resulting pulp, as well as the freeness and bulk of the pulp produced.

Preheating or steamheating of the lignocellulosic material before grinding has also been found to be of assistance in reducing energy requirements and facilitating defibration, according to German Pat. No. 40,049.

Swedish Pat. No. 318,178 describes a method for the defibration of lignocellulosic material by subjecting the material to grinding under a superatmospheric pressure of inert gas within the range from about 1.05 to about 10.5 kp/cm$^2$ above normal atmospheric pressure, and preferably within the range from about 2.1 to about 7 kp/cm$^2$ above normal atmospheric pressure, while supplying water at at least 71° C. and preferably about 99° C. during the grinding. This process provides a groundwood pulp having better drainability and improved tear resistance, while the energy consumption is less than that required in the usual process for the preparation of groundwood pulp.

U.S. Pat. No. 3,808,090, patented Apr. 30, 1974, to Logan and Luhde, in the text up to column 9, line 46, FIGS. 1 to 8 and Tables I to III is almost identical to the text of Swedish Pat. No. 318,178. The remainder of the Logan et al U.S. patent, from column 9, line 47 to column 13, line 42, is disclosed in Swedish Pat. No. 336,952, a patent of addition to Swedish Pat. No. 318,178, claiming the benefit of the priority of U.S. Ser. No. 569,351 of Aug. 1, 1966, now abandoned, referred to by Logan et al as a predecessor application to the application on which U.S. Pat. No. 3,808,090 issued. Swedish Pat. No. 336,952 includes Tables IV and V and FIG. 9 of the Logan et al U.S. Pat. No. 3,808,090.

The Logan et al U.S. patent during the mechanical abrasion of the wood applies a pressure within the range from about 0.7 to about 4.2 kp/cm$^2$, i.e., from 10 to 60 psig, with about 2.1 kp/cm$^2$ (30 psig) as a preferred range, a considerably narrower pressure range than that disclosed in Swedish Pat. No. 318,178.

Swedish Pat. No. 336,952 in this step applies a pressure within the range from about 1.4 to about 2.8 kp/cm$^2$, i.e., from 20 to 40 psig, which corresponds to the pressure disclosed in U.S. Pat. No. 3,948,449, patented Apr. 6, 1976. U.S. Pat. No. 3,948,449 in this step applies a pressure of from 10 to 80 psig (0.7 to 5.6 kp/cm$^2$), preferably from 20 to 40 psig (1.4 to 2.8 kp/cm$^2$).

However, it has been found that this process has numerous disadvantages. The brightness is unsatisfactorily low, according to present-day standards, only about 48 to 54% GE being obtained, according to Table I at page 4 of the Swedish patent. Even if bleaching chemicals are added to the shower water, the brightness is not noticeably improved, remaining within the range from about 38 to about 55% GE, even though very large amounts of bleaching chemicals are added. Tensile strength, although better than for ordinary groundwood pulp, as well as tear index and smoothness, are not as high as would be desirable. The amount of energy consumed is also comparatively high, taking into account current demands for low energy consumption and the decreasing availability of raw materials.

In accordance with the present invention, energy requirements in the production of groundwood pulp are further reduced and the quality of the pulp improved, including in particular, brightness and strength, by grinding debarked pulpwood logs under a superatmospheric pressure of a gas selected from the group consisting of steam, air and steam and air, while continuously supplying thereto process white water and water separated in thickening groundwood pulp suspension at a temperature within the range from about 75° to about 100° C., and forming a pulp suspension in the resulting aqueous liquor; centrifugally separating steam from the pulp suspension, and using the separated steam to heat the water supplied to the grinding; thickening the pulp suspension to a pulp concentration within the range from about 5 to about 40% and supplying water separated therefrom to the grinding; diluting the thickened pulp, and screening the diluted pulp suspension; thickening the screened rejects suspension to a pulp concentration of at least 10%, and defibrating the screened rejects suspension in a refiner; recycling the screened rejects suspension to the from-steam-separated pulp suspension; and mixing the thickened and refined rejects suspension, having a pulp concentration of at least 8%, with the pulp suspension, thereby increasing the pulp concentration of the from-steam-separated-pulp suspension, and thus facilitating its thickening.

The process of the invention makes it possible to produce groundwood pulp while consuming much less energy than in the normal procedures for grinding lignocellulosic material. The groundwood pulp obtained in accordance with the process of the invention has a greater brightness and an improved strength (as compared with the known groundwood pulps), which make it particularly suitable for the use in the manufacture of paper. Paper having a greater quality range can be obtained from the groundwood pulps in accordance with the invention.

The steam generated in the grinder is utilized as a source of energy for heating water applied during the grinding, and it can also be used for other heating needs in conjunction with the process of the invention or another process being carried on in the pulp manufacturing plant, such as, for example, drying pulp and preheating dilution water.

In the process in accordance with the invention, it is particularly advantageous to use as the heated water applied to the grinding filtrate water from a thickening step in the process, and heated process white water, together with a complexing agent. The solution thus obtained can be supplied to the grinder using a high pressure pump.

The groundwood pulp suspension discharged from the grinder is preferably passed through a coarse reject crusher, to assist in reducing the size of larger particulate material, and a pressure-seal tank, to facilitate uniformity of flow, and then led to a hydrocyclone for separating hot gases, including steam. A uniform flow to the hydrocyclone is important for optimum efficiency in operation and separation of steam and other hot gases.

The steam separated in the centrifugal separation step is used for heating the white water from the process, which is thence conducted to the reservoir from which the water is applied to the grinding. Heating the white water is suitably done by direct condensation of steam therein, and residual steam from the condenser can be utilized for other heating purposes. Thus, all of the steam generated in the process is utilized, and none goes to waste.

Before the filtrate from the thickening step is mixed with the water applied to the grinding, it is especially suitable to filter it so as to separate fibrous and other particulate material. This prevents blockages in the applicators and lines carrying it to the grinder, and applying it to the grindstone surfaces for cooling and cleaning.

In the process in accordance with the invention, a superatmospheric pressure is maintained during the grinding step within the range from about 0.1 to about 12 kp/cm$^2$ above atmospheric pressure, and preferably from about 0.25 to about 8.0 kp/cm$^2$, and the temperature of the shower water is held between about 75° and about 100° C., preferably within the range from about 90° to about 100° C. The debarked pulpwood logs should be pressed against the grinding stone surface at a pressure within the range from about 1 to about 35 kp/cm$^2$, and preferably from about 2 to about 20 kp/cm$^2$.

The FIGURE shows in flow sheet form a preferred embodiment of the process of the invention.

Debarked pulpwood logs of a suitable length and having a moisture content within the range from about 30 to about 65% are introduced through a pressure-sealing gate feeder 1 into the closed pressure chamber 2 of a grinder provided with a rotating grindstone 3. The logs are preheated by a flow of steam into the gate feeder each time the gate opens for feeding a number of logs into the grinder chamber. The logs are pressed against the grindstone in the grinding chamber with the aid of a hydraulic ram (not shown in the drawings), in such a way that the contact pressure against the grindstone surface is within the range from about 1 to about 35 kp/cm$^2$, and preferably from about 2 to about 20 kp/cm$^2$. During the grinding process, a superatmospheric pressure within the range from about 0.1 to about 12 kp/cm$^2$, and preferably from about 0.25 to about 8 kp/cm$^2$, is maintained in the grinder chamber 2, by supplying pressurized steam in line 4 and/or compressed air in line 5. The quality of the pulp obtained is directly dependent upon the pressure; which means that the greater the pressure, the better the quality of the pulp, as compared to a pulp obtained at a lower pressure.

While the pulpwood is being ground in the grinder, heated water is continuously supplied to the grinder by way of the line 24 and pump 23 from the storage tank 21. The water can be supplied at a flow rate within the range from about 400 to about 15000 liters per minute. While retaining the superatmospheric pressure in the grinder chamber, the pulp suspension obtained therefrom is discharged continuously to a coarse crusher 6 where large particles, shives and splinters in the suspension are broken up and then pass via line **6*a* to a pressure-seal tank 7**.

From the pressure-seal tank the pulp suspension is drawn in a continuous flow via line **7*a* to the hydrocyclone 8, for separating steam at a temperature within the range from about 100° to about 170° C. The separated steam is taken via line 25 to a condenser 19, where the steam is utilized for heating process white water which is to be supplied to the grinder. The steam is condensed directly in the water in the condenser. Excess steam from the condenser 19 is taken off in the line 26**, and used mainly for heating requirements in the process, but also as a source of energy for external heat and energy requirements.

From the hydrocyclone 8 the pulp suspension, now free of steam and usually having a pulp concentration within the range from about 1 to about 3%, is led via line **8*a* to the mixer 9, preferably a pulper, where it is mixed with hot defibrated rejects suspension flowing from the refiner 16 via line 17. As a result, the concentration in the pulp suspension is increased. The pulp suspension then passes via line 9*a* to the thickener 10, where its increased concentration (as increased in the mixer) facilitates the thickening, and a cleaner filtrate is obtained. Since this filtrate is utilized as water added to the grinding stage, its high purity is an important advantage. The thickener 10** can be a dewatering screw. In the thickener, the pulp suspension is thickened to a pulp concentration within the range from about 5 to about 40%.

The filtrate obtained in the thickener 10 has a temperature within the range from about 95° to about 100° C., and is led via line 12 to the filter 13, and from there to the water storage tank 21, which is insulated to prevent cooling of its contents. During passage through the filter 13, the filtrate is freed from fibers and other suspended impurities, thus preventing blockages in the lines, valves and nozzles downstream, as well as improving the suitability for cooling and cleaning the grindstone surface. The debris removed in the filter is withdrawn via line **13*a*. From the thickener 10 the thickened pulp is taken via line 10*a* to the screening stage 11**, where it is diluted and screened.

The screened pulp suspension is taken out of the system via line 18, and can be either further processed in a paper machine, or may first be subjected to lignin-preserving bleaching, after which it is thickened and dried or further treated in a paper machine in a bleached condition. The groundwood pulp obtained by the process of the invention is comparatively bright, and can be used to advantage for a large range of uses without bleaching.

The screen rejects from the screening stage 11 are led via line **11*a* to a thickener 14, preferably a dewatering screw, where they are thickened to a concentration of at least 10%, after which the thickened rejects suspension passes via line 14*a* to a refiner 16 where it is defibrated. The filtrate from the thickener 14 is recycled via line 15 to the screening stage 11**, as diluting water.

From the refiner 16, the hot defibrated rejects suspension having a pulp concentration of at least 8% and a temperature of at least 85° C. is led via line 17 to the mixer 9.

Process white water is utilized together with the filtrate from the thickener 10 as shower water in the grinding stage, and is introduced via line 27 to the condenser 19, where it is heated, preferably by direct condensation with steam generated in the grinder, and supplied to the condenser 19 via the hydrocyclone 8 and the line 25. The process white water heated to at least 90° C. is taken from the condenser via line 20 to the insulated water storage tank 21, where it is mixed with the mechanically cleaned filtrate entering via the line 12. A complexing agent supplied via line 22 can also be mixed into the water in the storage tank 21.

The hot water obtained is supplied to the grinder chamber 2 by way of the high pressure pump 23 and line 24, and is applied to the grindstone by spraying in a conventional manner at several points. The temperature of this shower water is within the range from about 75° to about 100° C., and preferably from about 90° to about 100° C.

Recycling the screened rejects in accordance with the invention to the special mixer immediately after the hydrocyclone results in a number of advantages, and gives a surprisingly good effect. It contributes to a high temperature being maintained in the pulp suspension, which in turn gives a high temperature in the filtrate from the thickener 10. Moreover, the pulp concentration in the mixer 9 increases, which has the effect that the subsequent thickening of the pulp suspension is facilitated, and the filtrate therefrom is cleaner. In contrast, in the conventional groundwood pulping process, the screen rejects, normally about a quarter of the total production, are recycled directly after defibration to the screening stage for rescreening.

Complexing agents which can be used in accordance with the invention can be any of the known complexing agents, such as for instance aminocarboxylic acids of the general formula:

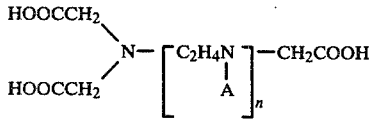

or alkali metal or magnesium salt thereof, in which formula A is the group $—CH_2COOH$ or $—CH_2CH_2OH$ and n is an integer from 0 to 5. Examples of such acids are ethylene diamine tetraacetic acid (EDTA), nitrilotriacetic acid (NTA), diethylene triamine pentaacetic acid (DTPA), ethylene diamine triacetic acid, tetraethylene pentaamine heptaacetic acid, hydroxy ethylene diamine triacetic acid and their alkali metal salts, including mono, di, tri, tetra and penta sodium, potassium and lithium salts thereof. Also other types of aminocarboxylic acids, such as iminodiacetic acid, 2-hydroxy ethylimino diacetic acid, cyclohexanediamine tetraacetic acid, anthranil-N,N-diacetic acid and 2-picolylamine-N,N-diacetic acid, may be used. Especially suitable complexing agents for use according to the present invention are ethylene diamine tetraacetic acid and diethylene triamine pentaacetic acid.

Examples of heavy metal organic complexing acids originating from the wood, and which may be present in the process white water and the water separated in the thickening 10, are aliphatic alphahydroxy carboxylic acids of the type RCHOHCOOH and corresponding betahydroxycarboxylic acids with the formula $RCHOHCH_2COOH$, in which formula R is hydrogen or an aliphatic radical, which may be a hydrocarbon radical with from one to ten carbon atoms or a hydroxy-substituted hydrocarbon radical with from one to nine hydroxyl groups and from one to ten carbon atoms, such as glycolic acid, lactic acid, 1,2-dihydroxy propionic acid, alpha, beta-dihydroxy butyric acid, beta-hydroxy-n-valeric acid and sugar acids and aldonic acids, such as gluconic acids, galactonic acid, mannonic acid and saccharinic acid.

A suitable amount of the complexing agent is within the range from about 0.001 to about 0.1 g/liter of shower water applied to the grinder, depending upon the amount of heavy metal in the pulp suspension. By complexing the heavy metals in the pulp during defibration, a brighter pulp is obtained than is the case if these are allowed to remain free in the pulp, for reaction with other substances.

The following Examples in the opinion of the inventors represent preferred embodiments of the invention:

EXAMPLE 1

This Example illustrates the industrial production of groundwood pulp in accordance with the invention in a plant laid out according to the FIGURE.

Debarked spruce logs having a moisture content of 50% were introduced into the sluice gate feeder 1 where they were contacted with steam coming from the grinder at the times when the sluice gate was open, and thus preheated to a certain extent. The logs then were deposited in batches in the closed grinding chamber 2 and pressed against the grindstone 3 by a hydraulic ram at a pressure of 6 $kp/cm^2$. A superatmospheric pressure of 1.5 $kp/cm^2$ above atmospheric was maintained in the grinding chamber during grinding by supplying a pressurized steam in the line 4. During grinding, the shower water heated to 96° C. was sprayed continuously against the grindstone, the water coming from the water tank 21 via the pump 23 and the line 24. The water was sprayed at a rate of flow of 1910 liters/minute.

The pulp suspension obtained, at a pulp concentration of 1.8% and a temperature of 111° C., was discharged continuously from the grinder and led to the pressure-seal tank 7 by way of the coarse particle crusher 6 and line 6a. The larger wood particles, shives and splinters in the discharge suspension were crushed and ground in the crusher, and thereafter the suspension could pass through valves, pipes and nozzles without difficulty.

The suspension was discharged in a uniform flow from the pressure-seal tank to the hydrocyclone 8. The uniform flow was maintained automatically by sensing and level controls in the tank (not shown in the FIGURE). The pulp suspension was freed from steam in the hydrocyclone 8, and this steam at a temperature of 101° C. was led by the line 25 to the condenser 19, where it was utilized by condensation in the process white water entering via the line 27, to heat the process white water to a suitable temperature, prior to being led to the grinding step.

The pulp suspension, now free from steam, with a pulp concentration of 1.8% and a temperature of 98° C., was led to the mixer 9 where it was mixed with recycled defibrated screen rejects suspension from the refiner 16, having a concentration of 20% and a temperature of 95° C. The concentration of the pulp suspension was thereby increased to 2.5%, and the temperature brought to 97° C.

This pulp suspension was further thickened in the thickener 10, a screw press, to a concentration of 10.0% while its temperature decreased to 96° C.

The filtrate from the thickening in the screw press 10, at a concentration of 0.15% and a temperature of 96° C., was led via line 12 to the filter 13. In the filter 13, the filtrate was freed from fibers and impurities, and its concentration decreased thereby to 0.03%. It then passed to the insulated storage tank 21, where it was mixed with the process white water heated to 96° C., supplied from the condenser 19 via line 20. Complexing agent, ethylene diamine tetraacetic acid, in an amount 0.08 g/liter was supplied to the tank 21 via the line 22.

The thickened pulp suspension was led to the screening stage 11, where it was screened after being diluted with water to a concentration of 2.0%. The screened pulp suspension was withdrawn by way of line 18.

The screened rejects suspension from the screening operation in the screening stage 11 was led via line 11*a* to the thickener 14 (in this case a dewatering screw), where it was thickened to a concentration of 24%, and then recycled to the mixer 9 via the refiner 16 where it was defibrated. When entering the mixer the recycled rejects suspension had a pulp concentration of 20%.

The filtrate obtained in the thickener 14 was recycled via the line 15 to the screening stage 11, where it was utilized as the diluting liquid.

Samples of the screened pulp suspension taken from the line 18 were analyzed, and their paper properties studied. The groundwood pulp showed the following properties:

Freeness, C.S.F., SCAN-C21:65: 120 ml
Brightness, SCAN-C11:62: 63%
Tensile index, SCAN-C28:69: 34 Nm/kg
Tear index, SCAN-P11:73: 5.1 $Nm^2/kg$
Density, SCAN-C28:69: 413 $kg/m^3$
Opacity, SCAN-C27:69: 91.0%

Total energy consumed in the groundwood grinder including the refiner stage 16 was measured to only 1175 kWh hours per ton of pulp produced. The energy was mostly used in the grinder for defibration. Since the generated heat was recycled in the form of steam for heating the water supplied to the grinding as well as used for other heating needs, the energy requirements of the process of the invention could be minimized, and was. In comparison with the method described in Swedish Pat. No. 318,178, where the process heat is not utilized in the hydrocyclone, and the process white water is not recirculated and filtered, nor are the rejects defibrated, the process according to the invention gives an energy saving of as much as 1050 kWh hours per ton of pulp produced, and surprisingly, the brightness is improved by four units, while good strength properties are retained.

EXAMPLE 2

This Example illustrates the industrial production of groundwood pulp in accordance with the invention in a plant laid out according to the FIGURE Debarked spruce logs having a moisture content of 50% were introduced into the sluice gate feeder 1 where they were contacted with steam coming from the grinder at the times when the sluice gate was open, and thus preheated to a certain extent. The logs then were deposited in batches in the closed grinding chamber 2 and pressed against the grindstone 3 by a hydraulic ram at a pressure of 6 $kp/cm^2$. A superatmospheric pressure of 1.5 $kp/cm^2$ above atmospheric was maintained in the grinding chamber during grinding by supplying pressurized steam in the line 4. During grinding, the shower water heated to 96° C. was sprayed continuously against the grindstone, the water coming from the water tank 21 via the pump 23 and the line 24. The water was sprayed at a rate of flow of 1910 liters/minute.

The pulp suspension obtained, at a pulp concentration of 1.8% and a temperature of 111° C., was discharged continuously from the grinder and led to the pressure-seal tank 7 by way of the coarse particle crusher 6 and line 6*a*. The larger wood particles, shives and splinters in the discharge suspension were crushed and ground in the crusher, and thereafter the suspension could pass through valves, pipes and nozzles without difficulty.

The suspension was discharged in a uniform flow from the pressure-seal tank to the hydrocyclone 8. The uniform flow was maintained automatically by sensing and level controls in the tank (not shown in the FIGURE). The pulp suspension was freed from steam in the hydrocyclone 8, and this steam at a temperature of 101° C. was led by the line 25 to the condenser 19, where it was utilized by condensation in the process white water entering via the line 27, to heat the process white water to a suitable temperature, prior to being led to the grinding step.

The pulp suspension, now free from steam, with a pulp concentration of 1.8% and a temperature of 98° C., was led to the mixer 9, a pulper, where it was mixed with recycled defibrated screen rejects suspension from the refiner 16, having a concentration of 20% and a temperature of 95° C. The concentration of the pulp suspension was thereby increased to 2.5%, and the temperature brought to 97° C.

This pulp suspension was further thickened in the thickener 10, a screw press, to a concentration of 10.0%, while its temperature decreased to 96° C.

The filtrate from the thickening in the screw press 10, at a concentration of 0.15% and a temperature of 96° C., was led via line 12 to the filter 13. In the filter 13, the filtrate was freed from fibers and impurities, and its concentration decreased thereby to 0.03%. It then passed to the insulated storage tank 21, where it was mixed with the process white water heated to 96° C., supplied from the condenser 19 via the line 20.

The thickened pulp suspension was led to the screening stage 11, where it was screened after being diluted with water to a concentration of 2.0%. The screened pulp suspension was withdrawn by way of line 18.

The screened rejects suspension from the screening operation in the screening stage 11 was led via line 11*a* to the thickener 14 (in this case a dewatering screw), where it was thickened to a concentration of 24%, and then recycled to the mixer 9 via the refiner 16 where it was defibrated. When entering the mixer the recycled rejects suspension had a pulp concentration of 20%.

The filtrate obtained in the thickener 14 was recycled via the line 15 to the screening stage 11, where it was utilized as the diluting liquid.

Samples of the screened pulp suspension taken from the line 18 were analyzed and their paper properties studied. The groundwood pulp showed the following properties:

Freeness, C.S.F. SCAN-C21:65: 125 ml
Brightness, SCAN-C11:62: 59%
Tensile index, SCAN-C28:69: 33 Nm/kg
Tear index, SCAN-P11:73: 4.9 $Nm^2/kg$
Density, SCAN-C28:69: 410 $kg/m^3$
Opacity, SCAN-C27:69: 91.0%

Total energy consumed in the groundwood grinder including the refiner stage 16 was measured to only 1175 kWh hours per ton of pulp produced. The energy was mostly used in the grinder for defibration. Since the generated heat was used in the form of steam for heating the water supplied to the grinding step as well as for other heating needs, the energy requirements of the process of the invention could be minimized, and was. In comparison with the method described in Swedish Pat. No. 318,178 where the process heat is not utilized in the hydrocyclone and the process white water is not recirculated and filtered, nor are the rejects defibrated, the process according to the invention gives an energy saving of as much as 1050 kWh hours per ton of pulp produced.

It is, however, apparent from the results that the groundwood pulp obtained in accordance with this procedure was darker than that of the pulp of Example 1, because no complexing agent was present. The heavy metals therefore were not chelated, and could lead to discoloration of the pulp, and did.

Having regard to the foregoing disclosure, the following is claimed as the inventive and patentable embodiments thereof:

1. A process for the production of groundwood pulp of improved brightness and strength, and with a relatively low energy requirement, comprising:

(1) grinding debarked pulpwood logs under a superatmospheric pressure of a gas selected from the group consisting of steam, air and steam and air while continuously supplying thereto process white water and water separated in thickening groundwood pulp suspension at a temperature within the range from about 75° to about 100° C., and forming a pulp suspension in the resulting aqueous liquor;

(2) centrifugally separating steam from the pulp suspension, and using the separated steam to heat the water supplied to the grinding;

(3) thickening the pulp suspension to a pulp concentration within the range from about 5 to about 40% and supplying water separated therefrom to the grinding;

(4) diluting the thickened pulp and screening the diluted pulp suspension;

(5) thickening the screened rejects suspension to a pulp concentration of at least 10% and defibrating the screened rejects suspension in a refiner, recycling the screened rejects suspension to the from-steam-separated pulp suspension (2); and (6) mixing the recycled, thickened and refined rejects suspension, having a pulp concentration of at least 8%, with the pulp suspension from step (2) thereby increasing the pulp concentration of the from-steam-separated pulp suspension from step (2), facilitating its thickening in step (3).

2. A process according to claim 1 in which only process white water and water separated in thickening pulp suspension from the process are supplied to the grinding, and only hot steam or water from the process are applied to heat the water supplied to the grinding.

3. A process according to claim 1 in which the heated water supplied to the grinding is supplied with complexing agents to chelate heavy metals.

4. A process according to claim 1 which comprises separating steam from the grinder therewith the debarked pulpwood logs fed to the grinder.

5. A process according to claim 1 in which the groundwood pulp suspension discharged from the grinder is passed through a crusher, thereby reducing the size of larger particulate material, and a pressure-seal tank, to facilitate uniformity of flow, and then led to a hydrocyclone for separating steam.

6. A process according to claim 1 in which the steam separated in the centrifugal separation step (2) is used for heating water applied to the grinding by direct condensation of steam therein.

7. A process according to claim 1 in which the water separated in the separation step (3) is filtered so as to separate fibrous and other particulate material before it is mixed with process white water.

8. A process according to claim 1 in which during the grinding step the superatmospheric pressure is maintained within the range from about 0.1 to about 12 $kp/cm^2$ above atmospheric pressure, and the debarked pulpwood logs are pressed against the grindstone surface at a pressure within the range from about 1 to about 35 $kp/cm^2$.

* * * * *

UNITED STATES PATENT AND TRADEMARK OFFICE

CERTIFICATE OF CORRECTION

PATENT NO. : 4,207,139

DATED : June 10, 1980

INVENTOR(S) : Jonas A.I. Lindahl et al

It is certified that error appears in the above-identified patent and that said Letters Patent are hereby corrected as shown below:

| | |
|---|---|
| Column 5, line 34 : | "salt" should be --salts--. |
| Column 6, line 23 : | delete "a" after "supplying". |
| Column 10, line 18: | insert --and heating-- after "grinder". |

Signed and Sealed this

*Ninth* Day of *September 1980*

[SEAL]

*Attest:*

SIDNEY A. DIAMOND

*Attesting Officer*

*Commissioner of Patents and Trademarks*